US009818326B2

(12) United States Patent
Lin et al.

(10) Patent No.: US 9,818,326 B2
(45) Date of Patent: Nov. 14, 2017

(54) DISPLAY DRIVING APPARATUS, METHOD FOR DRIVING DISPLAY PANEL AND DISPLAY PANEL

(71) Applicant: Novatek Microelectronics Corp., Hsinchu (TW)

(72) Inventors: Li-Tang Lin, Hsinchu (TW); Teng-Jui Yu, Taoyuan (TW)

(73) Assignee: Novatek Microelectronics Corp., Hsinchu (TW)

( * ) Notice: Subject to any disclaimer, the term of this patent is extended or adjusted under 35 U.S.C. 154(b) by 50 days.

(21) Appl. No.: 14/720,976

(22) Filed: May 26, 2015

(65) Prior Publication Data

US 2016/0125779 A1 May 5, 2016

(30) Foreign Application Priority Data

Oct. 29, 2014 (TW) ..... 103137407 A

(51) Int. Cl.
*G09G 3/20* (2006.01)

(52) U.S. Cl.
CPC ..... *G09G 3/20* (2013.01); *G09G 2300/0426* (2013.01); *G09G 2310/0205* (2013.01); *G09G 2310/0218* (2013.01); *G09G 2320/0252* (2013.01)

(58) Field of Classification Search
CPC ..... G09G 2310/0251; G09G 2310/062; G09G 3/20
See application file for complete search history.

(56) References Cited

U.S. PATENT DOCUMENTS

| | | | |
|---|---|---|---|
| 8,723,194 | B2 | 5/2014 | Chiang et al. |
| 8,723,772 | B2 | 5/2014 | Yang et al. |
| 8,779,436 | B2 | 7/2014 | Chen et al. |
| 9,082,363 | B2 | 7/2015 | Chang et al. |
| 9,087,472 | B2 | 7/2015 | Chen et al. |
| 9,123,591 | B2 | 9/2015 | Chen et al. |

(Continued)

FOREIGN PATENT DOCUMENTS

| | | |
|---|---|---|
| TW | 201040923 | 11/2010 |
| TW | 201133457 | 10/2011 |

(Continued)

OTHER PUBLICATIONS

"Office Action of Taiwan Counterpart Application", dated Dec. 15, 2015, p. 1-p. 8.

*Primary Examiner* — Nelson Rosario
*Assistant Examiner* — Chun-Nan Lin
(74) *Attorney, Agent, or Firm* — JCIPRNET

(57) ABSTRACT

A display panel including a plurality of pixels, a plurality of scan lines and a plurality of data lines is provided. The pixels are arranged in an array, and the array includes columns and rows. Each of the scan lines is coupled to the pixels located on the same row. Each of the data lines is coupled to the pixels located on the same column. The data lines are grouped into a plurality of data line groups, and each of the data line groups includes three or more data lines. The data line groups are respectively located between the pixels on the same row. The data line groups are configured to write display data into the pixels when the pixels are turned on. A display driving apparatus and a method for driving the display panel are also provided.

28 Claims, 8 Drawing Sheets

(56) References Cited

U.S. PATENT DOCUMENTS

| | | | | |
|---|---|---|---|---|
| 9,196,210 | B2 | 11/2015 | Chang et al. | |
| 2006/0017668 | A1* | 1/2006 | Shirasaki | G09G 3/325 345/76 |
| 2008/0068524 | A1* | 3/2008 | Kim | G02F 1/136286 349/38 |
| 2011/0279443 | A1 | 11/2011 | Chang et al. | |
| 2012/0120035 | A1 | 5/2012 | Yang et al. | |
| 2012/0188166 | A1* | 7/2012 | Nurmi | G09G 3/3648 345/168 |
| 2013/0256707 | A1 | 10/2013 | Chiang et al. | |
| 2013/0321251 | A1* | 12/2013 | Kang | G09G 3/36 345/87 |
| 2014/0054624 | A1 | 2/2014 | Chen et al. | |
| 2014/0104260 | A1 | 4/2014 | Chang et al. | |
| 2014/0152640 | A1 | 6/2014 | Chen et al. | |
| 2014/0253607 | A1 | 9/2014 | Xue et al. | |
| 2014/0264357 | A1 | 9/2014 | Chen et al. | |
| 2015/0325198 | A1 | 11/2015 | Chen et al. | |

FOREIGN PATENT DOCUMENTS

| | | |
|---|---|---|
| TW | 201140548 | 11/2011 |
| TW | 201312535 | 3/2013 |
| TW | 201341924 | 10/2013 |
| TW | 201409139 | 3/2014 |
| TW | 201417081 | 5/2014 |
| TW | 201421113 | 6/2014 |

* cited by examiner

DISPLAY DRIVING APPARATUS, METHOD FOR DRIVING DISPLAY PANEL AND DISPLAY PANEL

CROSS-REFERENCE TO RELATED APPLICATION

This application claims the priority benefit of Taiwan application serial no. 103137407, filed on Oct. 29, 2014. The entirety of the above-mentioned patent application is hereby incorporated by reference herein and made a part of this specification.

BACKGROUND OF THE INVENTION

Field of the Invention

The invention relates to a display driving apparatus, a method for driving a display panel and a display panel, and more particularly, relates to an arranging method for data lines in a display panel and a display driving apparatus and a method for driving the display panel.

Description of Related Art

Generally, in an arranging method for pixels in the conventional display panel, one data line is usually located between the pixels of the same row. The data line is configured to connect a driving circuit to a plurality of pixels, and write display data into the pixels when the pixels are turned on, so as to drive the display panel. A gate driving circuit can sequentially apply scan signals on scan lines so that a source driving circuit can utilize the scan lines to charge the pixels in order to write the display data into the pixels. Accordingly, when a screen resolution and a screen update frequency of the display panel are confirmed, a time for the gate driving circuit to sequentially turn on rows of the pixels may then be obtained. With increases in the screen resolution and the screen update frequency of the display panel, a time for the rows of the pixels to be turned on is shorten, which means that a time for the source driving circuit to charge the pixels is also shorten. In a circumstance where the time for charging the pixels is insufficient, a display quality of the display panel may be affected accordingly.

SUMMARY OF THE INVENTION

The invention is directed to a display driving apparatus for driving a display panel in which three or more data lines are located between pixels in order to improve a charging speed for the pixels.

The invention is directed to a method for driving a display panel in which three or more data lines are located between pixels in order to improve a charging speed for the pixels.

The invention is directed to a display panel in which three or more data lines are located between pixels in order to improve a charging speed for the pixels.

The display driving apparatus of the invention is configured to drive a display panel. The display panel includes a plurality of pixels arranged in an array. The array includes a plurality of columns and a plurality of rows. The display driving apparatus includes a driver unit. The driver unit is electrically connected to the display panel and configured to drive the display panel to turn on the pixels of the display panel. The display panel further includes a plurality of scan lines and a plurality of data lines. Each of the scan lines is coupled to a plurality of pixels located on the same row among the pixels, and each of the data lines is coupled to a plurality of pixels located on the same column among the pixels. The data lines are grouped into a plurality of data line groups. Each of the data line groups includes three or more data lines among the data lines. The data line groups are respectively located between the pixels on the same row. The driver unit drives the data line groups to write display data into the pixels when the pixels are turned on.

The method for driving the display panel of the invention includes: driving the display panel to turn on the pixels of the display panel; and driving the data lines to write display data into the pixels when the pixels are turned on. The pixels are arranged in an array. The array includes a plurality of columns and a plurality of rows. Each of the scan lines is coupled to a plurality of pixels located on the same row among the pixels, and each of the data lines is coupled to a plurality of pixels located on the same column among the pixels. The data lines are grouped into a plurality of data line groups. Each of the data line groups includes three or more data lines among the data lines. The data line groups are respectively located between the pixels on the same row.

The display panel of the invention includes a plurality of pixels, a plurality of scan lines and a plurality of data lines. The pixels are arranged in an array, and the array includes a plurality of columns and a plurality of rows. Each of the scan lines is coupled to a plurality of pixels located on the same row among the pixels. Each of the data lines is coupled to a plurality of pixels located on the same column among the pixels. The data lines are grouped into a plurality of data line groups, and each of the data line groups includes three or more data lines. The data line groups are respectively located between the pixels on the same row, and configured to write display data into the pixels when the pixels are turned on.

In an embodiment of the invention, in the display panel, each of the data lines is coupled to a part of the pixels located on the same column among the pixels.

In an embodiment of the invention, in the display panel, in at least a part of the data line groups, the pixels in which the display data is written by the three or more data lines are distributed at two sides of the three or more data lines.

In an embodiment of the invention, in the display panel, in at least a part of the data line groups, a part of the pixels among the pixels in which the display data is written by the three or more data lines is located on the same column.

In an embodiment of the invention, in the display panel, in at least a part of the data line groups, at least one pixel among the pixels in which the display data is written by the three or more data lines is located on a first column of the columns. Other pixels among the pixels in which the display data is written by the three or more data lines are located on a second column of the columns. The first column is distinct from the second column.

In an embodiment of the invention, in the display panel, in at least a part of the data line groups, a part of the pixels among the pixels in which the display data is written by the three or more data lines is located on the same row.

In an embodiment of the invention, in the display panel, in at least a part of the data line groups, all of the pixels among the pixels in which the display data is written by the three or more data lines are not located on the same row.

In an embodiment of the invention, in the display panel, the scan lines are grouped into a plurality of scan line groups. Each of the scan line groups includes three or more scan lines among the scan lines. An amount of the data lines included in each of data line groups is equal to an amount of the scan lines included in each of the scan line groups.

In an embodiment of the invention, in the display panel, rows of the pixels connected to the scan lines of each of the scan line groups are turned on at the same time.

In an embodiment of the invention, in the display panel, in at least a part of the scan line groups, the three or more scan lines are adjacent to one another.

In an embodiment of the invention, in the display panel, in at least a part of the scan line groups, one of the scan lines among the three or more scan lines is not adjacent to the other scan lines among the three or more scan lines.

In an embodiment of the invention, in the display panel, in at least a part of the scan line groups, the three or more scan lines are not adjacent to one another.

Based on the above, in the embodiments of the invention, at least three data lines are included between the pixels of the display panel in order to improve a charging speed for the pixels and overcome the issue that the charging time is insufficient.

To make the above features and advantages of the disclosure more comprehensible, several embodiments accompanied with drawings are described in detail as follows.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1A:
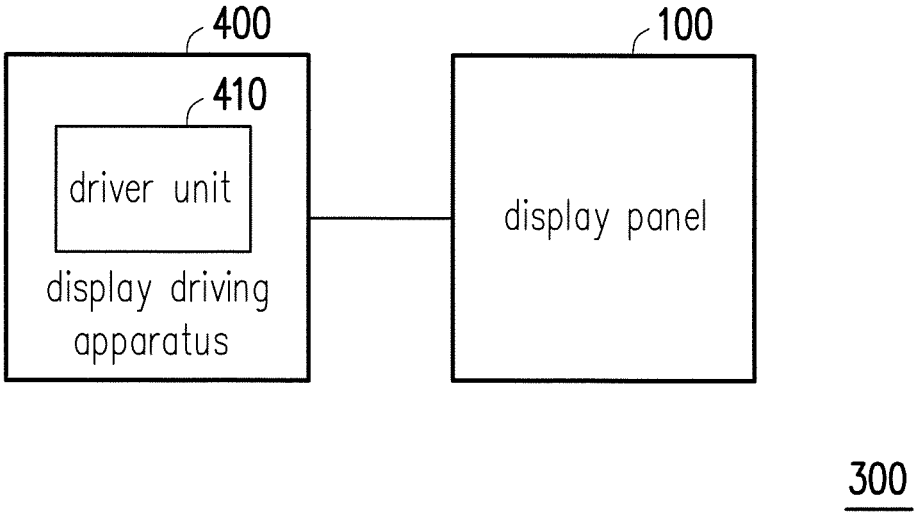
FIG. 1A is a schematic diagram illustrating a display system according to an embodiment of the invention.

Reference will now be made in detail to the present preferred embodiments of the invention, examples of which are illustrated in the accompanying drawings. Wherever possible, the same reference numbers are used in the drawings and the description to refer to the same or like parts.

Figure 1B:
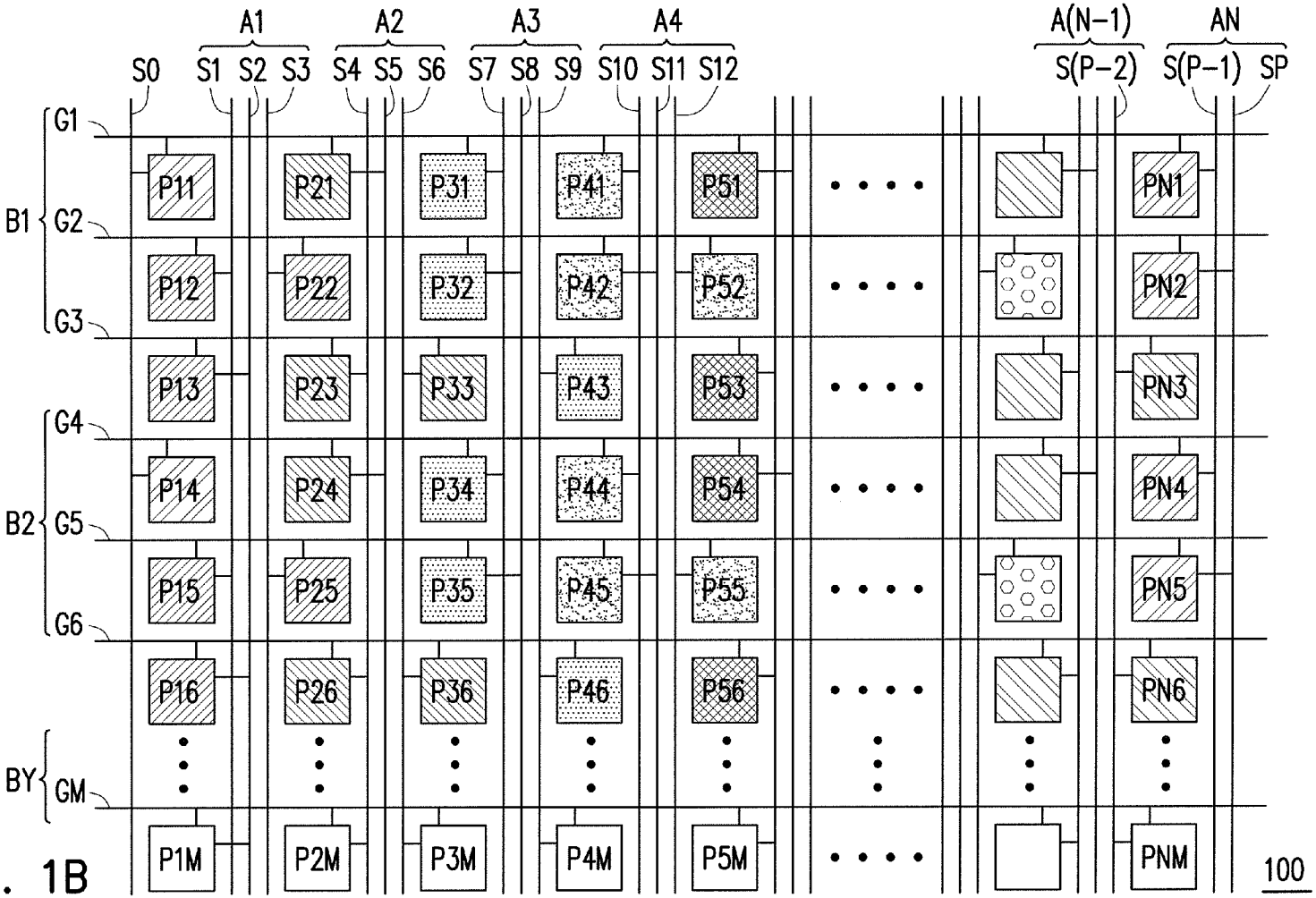
FIG. 1B is a schematic diagram illustrating a pixel array of a display panel according to an embodiment of the invention.
Figure 2:
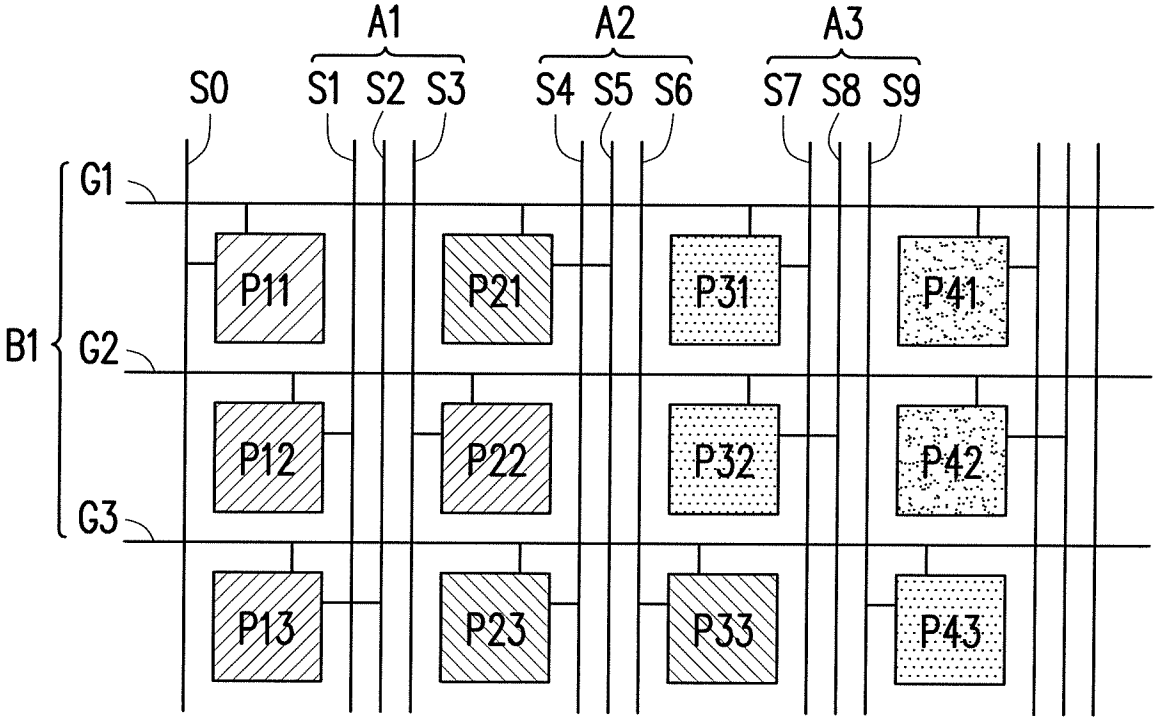
FIG. 2 is a schematic diagram illustrating a part of the pixels in the embodiment of FIG. 1B.
Figure 3:
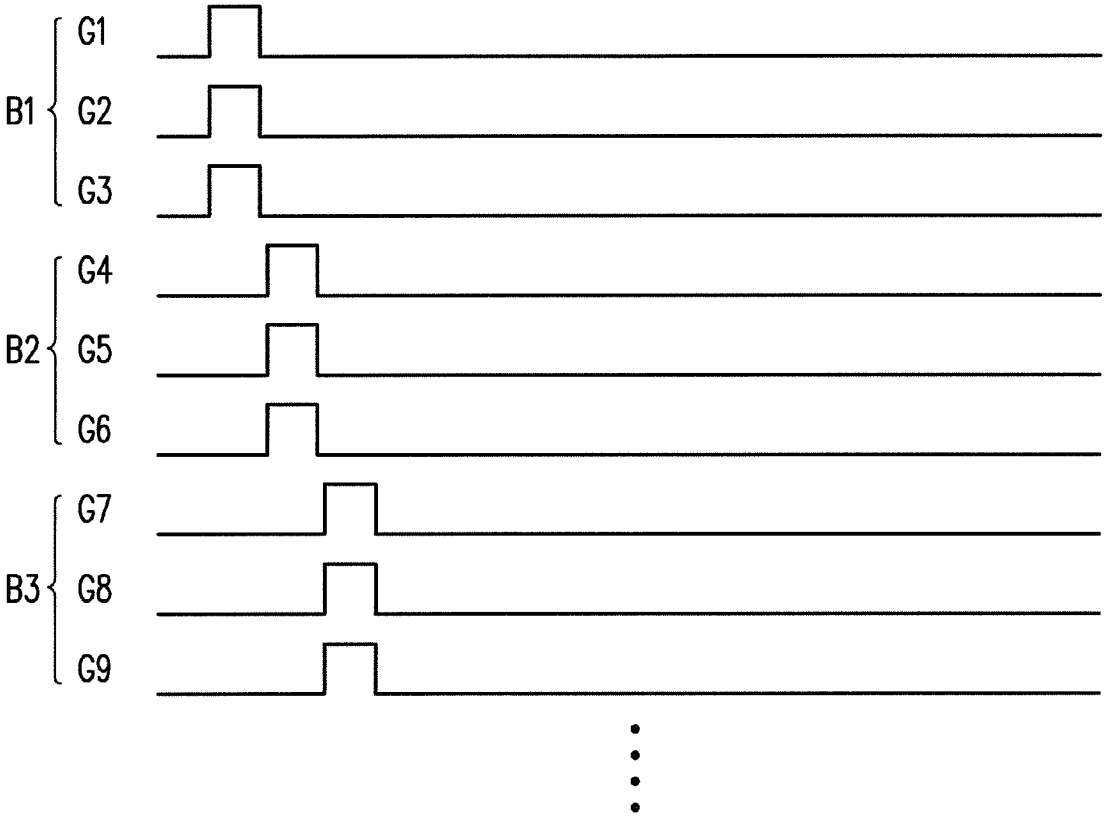
FIG. 3 is a schematic diagram illustrating a timing sequence of scan signals for driving the display panel of FIG. 1B according to an embodiment of the invention.

FIG. 1A is a schematic diagram illustrating a display system according to an embodiment of the invention. FIG. 1B is a schematic diagram illustrating a pixel array of a display panel according to an embodiment of the invention. FIG. 2 is a schematic diagram illustrating a part of the pixels in the embodiment of FIG. 1B. FIG. 3 is a schematic diagram illustrating a timing sequence of scan signals for driving the display panel of FIG. 1B according to an embodiment of the invention.

Referring to FIG. 1A to FIG. 3, in the present embodiment, the display panel 100 includes a plurality of scan lines G1 to GM, a plurality of data lines S0 to SP and a plurality of pixels P11 to PNM, wherein M, N, P are positive integers greater than 1. In the present embodiment, the display system 300 includes a display driving apparatus 400 and the display panel 100. The display driving apparatus 400 includes a driver unit 410. The driver unit 410 is electrically connected to the display panel 100. The driver unit 410 may at least include a source driver or a gate driver, but the invention is not limited thereto. The driver unit 410 may drive the display panel 100 to turn on the pixels P11 to PNM of the display panel 100 by using scan signals via the scan lines G1 to GM of the display panel 100. Furthermore, the driver unit 410 may also write pixel data into the pixels P11 to PNM via the data lines S0 to SP of the display panel 100 when the pixels P11 to PNM are turned on.

In the present embodiment, the pixels P11 to PNM are arranged in an array as shown in FIG. 1B, and the array includes a plurality of columns and a plurality of rows. For example, a first row of the pixels includes the pixels P11, P21 to PN1, a first column of the pixels includes the pixels P11, P12 to P1M, and the rest may be deduced by analogy. In the display panel 100, the scan lines G1 to GM are located between each row of the pixels. In the present embodiment, the scan lines G1 to GM are respectively coupled to a plurality of pixels located on the same row among the pixels P11 to PNM. For example, the scan line G1 is coupled to the first row of the pixels (P11 to PN1), and the scan line G2 is located between the first row of the pixels (P11 to PN1) and a second row of the pixels (P12 to PN2), and coupled to the second row of the pixels (P12 to PN2).

Further, in the present embodiment, in the display panel 100, the data lines S1 to S(P−2) are located between each column of the pixels. The data lines S1 to S(P−2) are respectively coupled to a plurality of pixels located on the same column among the pixels. For example, the data line S1 is located between the first column of the pixels (P11 to P1M) and a second column of the pixels (P21 to P2M), and coupled to the pixels such as a part of the pixels (P12, P15) among the first column of the pixels (P11 to P1M). The data line S2 is also located between the first column of the pixels (P11 to P1M) and the second column of the pixels (P21 to P2M), and coupled to the pixels such as a part of the pixels (P13) among the first column of the pixels (P11 to P1M). The data line S3 is also located between the first column of the pixels (P11 to P1M) and the second column of the pixels (P21 to P2M), and coupled to the pixels such as a part of the pixels (P22, P25) among the second column of the pixels (P21 to P2M). In another embodiment, based on actual design requirements, the data line S1 and the data line S2 may also be coupled to different parts of the pixels among the second column of the pixels (P21 to P2M), and the data line S3 may also be coupled to a different part of the pixels among the first column of the pixels (P11 to P1M), which are not particularly limited in the invention.

In the present embodiment, the data lines S0 to SP are grouped into a plurality of data line groups A1 to AN. In the present embodiment, each of the data line groups A1 to AN includes three or more data lines among the data lines S0 to SP. For example, the data line group A1 includes the data lines S1 to S3. Among them, the data line group AN includes, for example, the data lines S0, S(P−1), SP. The data line groups A1 to A(N−1) are respectively located between the pixels on the same row. For example, the data lines S1 to S3 are located between the first column of the pixels (P11 to P1M) and the second column of the pixels (P21 to P2M). The data lines S0 to SP are configured to write display data into the pixels when the pixels are turned on.

In the present embodiment, each of the scan lines G1 to GM is coupled to all of the pixels located on the same row among the pixels P11 to PNM. For example, because the scan line G1 is coupled to the first row of the pixels (P11 to PN1), when the scan signal of the scan line G1 is at a high level, the pixels P11 to PN1 located on the same row are turned on at the same time. Connecting relations between the scan lines G2 to GM and each of the pixels are as shown in FIG. 1B, which may be deduced by analogy.

Furthermore, in the present embodiment, each of the data line groups A1 to AN includes three data lines. In correspondence to an amount of the data lines included in each of the data line groups A1 to AN, the scan lines G1 to GM are grouped into a plurality of scan line groups B1 to BY, wherein Y is a positive integer greater than 1. Each of the scan line groups B1 to BY includes three scan lines among the scan lines G1 to GM. As shown in FIG. 3, within the same driving timing sequence, the scan signals corresponding to the scan line groups are in a high level state at the same time, so as to turn on the row of the pixels coupled to each of the scan line groups altogether. For instance, in FIG. 3, the scan signals of the scan lines G1 to G3 of the scan line group B1 are in the high level state at the same time within one driving timing sequence. The scan signals of the scan lines G4 to G6 of the scan line group B2 are also in the high level state at the same time within another driving timing sequence. In the present embodiment, the level states of the scan signals of the rest of the scan lines may be inferred by analogy, which are not repeated hereinafter.

In other words, in the present embodiment, an amount of the data lines included in each of data line groups A1 to AN is equal to an amount of the scan lines included in each of the scan line groups B1 to BY. For example, in the present embodiment, because each of the data line groups A1 to AN includes three data lines among the data lines S0 to SP, each of the scan line groups B1 to BY includes three scan lines as the corresponding amount. That is to say, the scan line group B1 includes the scan lines G1 to G3. Each one of the three scan lines included in each of the scan line groups B1 to BY is configured to correspondingly turn on all of the pixels located on the same row. For example, the scan lines G1 to G3 included in the scan line group B1 are configured to correspondingly turn on the pixels P11 to PN1, the pixels P12 to PN2 and the pixels P13 to PN3.

It should be noted that, the scan line groups in the exemplary embodiment of the invention are not limited to only include adjacent scan lines. In an embodiment, the scan line group can also include any three scan lines among all of the scan lines. For example, the scan line group B1 can also include the scan lines G1, G2 and G4. In other words, in the scan line group B1, one of the scan lines (G4) is not adjacent to the other scan lines (G1, G2). Within the same driving timing sequence, the scan signals of the scan lines G1, G2 and G4 are in the high level state at the same time. In an embodiment, the scan line group B1 can also include the scan lines G1, G4 and G7. In other words, in the scan line group B1, the three of the scan lines G1, G4 and G7 are not adjacent to one another. Within the same driving timing sequence, the scan signals of the scan lines G1, G4 and G7 are in the high level state at the same time. That is to say, in an embodiment of the invention, for the scan lines of the same scan line group, the scan signals are in the high level state at the same time within the same driving timing sequence. It should be noted that, the scan lines included in the scan line group is decided and adjusted in accordance with a coupling relation of the data line group and the pixels.

FIG. 2 is a schematic diagram illustrating a part of the pixels in the embodiment of FIG. 1B. Specifically, referring to FIG. 2, in the present embodiment, the data lines S1 to S9 are respectively coupled to a part of the pixels located on the same column among the pixels P11 to P43. Take the data line group A1 for example, in FIG. 2, the data line S1 is coupled to the pixel P12, the data line S2 is coupled to the pixel P13, and the data line S3 is coupled to the pixel P22. In this example, the pixels coupled to the data line group A1 are located at two sides of the data lines S1 to S3. For example, the pixel P12 and the pixel P13 are located on the same side, and the pixel P12 and the pixel P22 are located on different sides. In the present embodiment, each of the data line groups is coupled to a part of the pixels located on the same column among the pixels. For example, in the first column of the pixels (P11 to P13), the pixels P12 and P13 are coupled to the data lines S1 and S2 of the data line group A1 respectively. In the second column of the pixels (P21 to P23), the pixel P22 is coupled to the data line S3 of the data line group A1. Therefore, in the present embodiment of the invention, in at least a part of the data line groups, the pixels in which the display data is written by the data lines are distributed at two sides of the data line group.

Take the data line group A2 as another example, in the present embodiment, the data line group A2 is located between the column of the pixels (P21 to P23) and the column of the pixels (P31 to P33). The data line S5 is coupled to the pixel P21, the data line S4 is coupled to the pixel P23, and the data line S6 is coupled to the pixel P33. In view of the above, in at least a part of the data line groups, a part of the pixels among the pixels in which the display data is written by the data lines is located on the same column. In other embodiments, in at least a part of the data line groups, at least one pixel among the pixels in which the display data is written by the data lines and other pixels among the pixels in which the display data is written by the data lines are not located on the same column. Take the present embodiment for example, among the pixels P21 to P23 and P31 to P33 on the two sides of the data line group A2, the pixel P12 and the pixel P23 are located on the same column, but the pixel P31 and said two pixels are not located on the same column.

In the present embodiment, in at least a part of the data line groups, a part of the pixels among the pixels in which the display data is written by the data lines is located on the same row. In other words, in the data line group A1, a part of the pixels among the pixels P12, P13 and P22 in which the display data is written by the data lines S1 to S3 is located on the same row, namely, the pixels P12 and P22 are located on the same row. Further, in the present embodiment, in at least a part of the data line groups, all of the pixels among the pixels in which the display data is written by the data lines are not located on the same row. Take the data line group A3 for example, among the pixels P31, P32 and P43 in which the display data is written by the data lines S7 to S9, the pixels P31, P32 and P43 are not located on the same row.

In the forgoing embodiments of FIG. 1B to FIG. 3, the amount of the data lines included in each of the data line groups is three, but the invention is not limited thereto. In other embodiments, each of the data line groups can also include more than three data lines, such as four data lines, as shown in the embodiment of FIG. 4.

Figure 4:
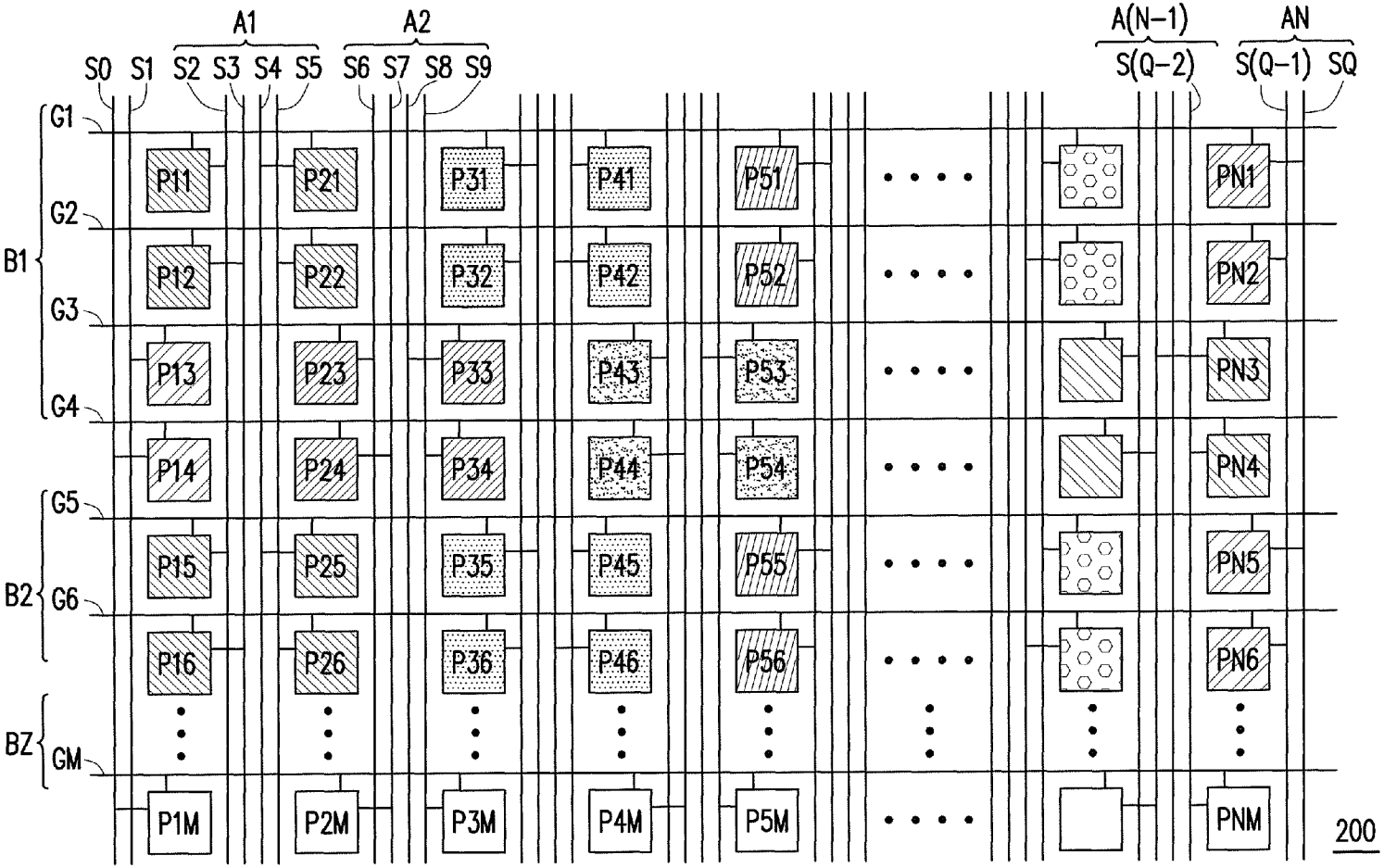
FIG. 4 is a schematic diagram illustrating a pixel array of a display panel according to another embodiment of the invention.
Figure 5:
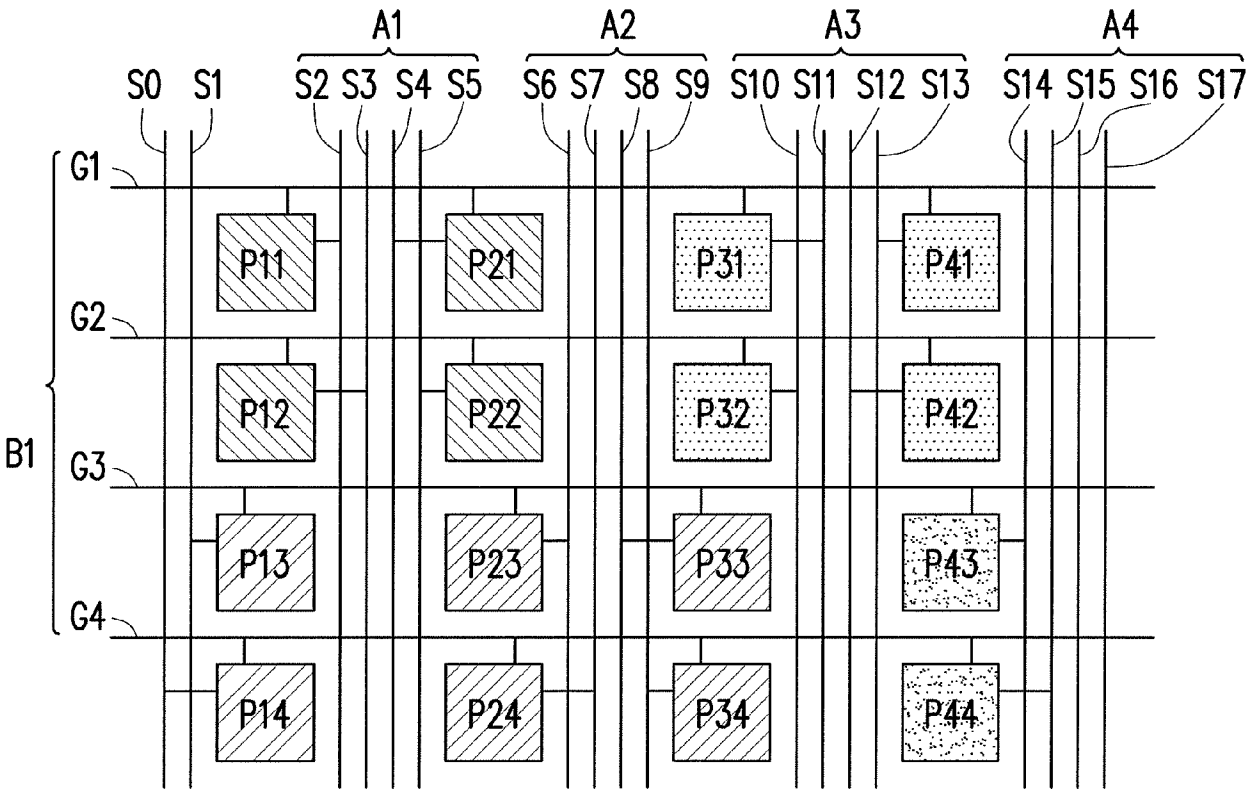
FIG. 5 is a schematic diagram illustrating a part of the pixels in the embodiment of FIG. 4.
Figure 6:
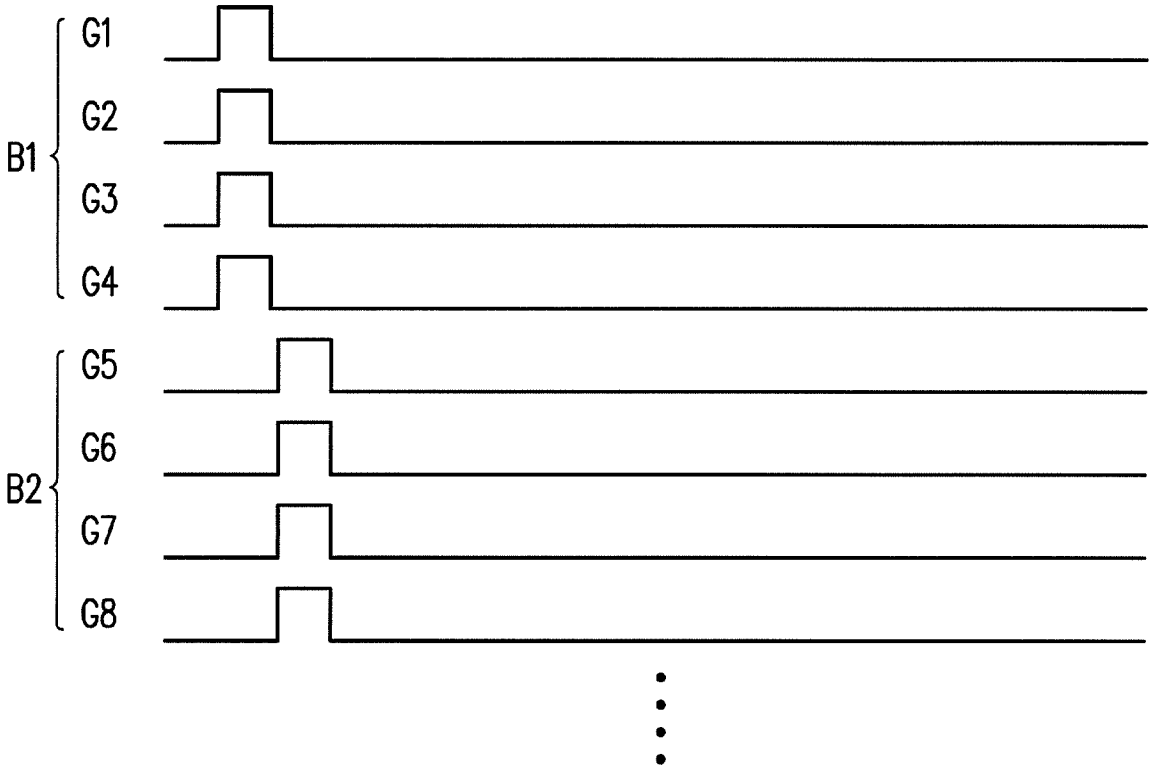
FIG. 6 is a schematic diagram illustrating a timing sequence of scan signals for driving the display panel of FIG. 4 according to another embodiment of the invention.

FIG. 4 is a schematic diagram illustrating a pixel array of a display panel according to another embodiment of the invention. FIG. 5 is a schematic diagram illustrating a part of the pixels in the embodiment of FIG. 4. FIG. 6 is a schematic diagram illustrating a timing sequence of scan signals for driving the display panel of FIG. 4 according to another embodiment of the invention. Referring to FIG. 4 to FIG. 6, a display panel 200 of the present embodiment is similar to the display panel 100 of FIG. 1B, and a major difference between the two is that, for example, each of the data line groups includes four data lines in the present embodiment.

Specifically, in the present embodiment, the display panel 200 includes a plurality of scan lines G1 to GM, a plurality of data lines S0 to SQ and a plurality of pixels P11 to PNM, wherein M, N, Q are positive integers greater than 1. The pixels P11 to PNM are arranged in an array as shown in FIG. 4, and the array includes a plurality of columns and a plurality of rows. In the present embodiment, in the display panel 200, the data lines S2 to S(Q−2) are located between each column of the pixels. The data lines S1 to SQ are respectively coupled to a plurality of pixels located on the same column among the pixels. For example, the data line S2 is located between a first column of the pixels (P11 to P1M) and a second column of the pixels P21 to P2M), and coupled to the pixels such as a part of the pixels (P11, P15) among the first column of the pixels (P11 to P1M). The data line S3 is also located between the first column of the pixels (P11 to P1M) and the second column of the pixels (P21 to P2M), and coupled to the pixels such as a part of the pixels (P12, P16) among the first column of the pixels (P11 to P1M). The data line S4 is also located between the first column of the pixels (P11 to P1M) and the second column of the pixels (P21 to P2M), and coupled to the pixels such as a part of the pixels (P21, P25) among the second column of the pixels (P21 to P2M). The data line S5 is also located between the first column of the pixels (P11 to P1M) and the second column of the pixels (P21 to P2M), and coupled to the pixels such as a part of the pixels (P22, P26) among the second column of the pixels (P21 to P2M). In another embodiment, based on actual design requirements, the data line S2 and the data line S3 may also be coupled to different parts of the pixels among the second column of the pixels (P21 to P2M), and the data line S4 and the data line S5 may also be coupled to different parts of the pixels among the first column of the pixels (P11 to P1M), which are not particularly limited in the invention.

In the present embodiment, the data lines S0 to SQ are grouped into a plurality of data line groups A1 to AN, wherein X is a positive integer greater than 1. In the present embodiment, each of the data line groups A1 to AN includes four data lines among the data lines S0 to SQ. For example, the data line group A1 includes the data lines S2 to S5. Among them, the data line group AN includes, for example, the data lines S0, S1, S(Q−1), SQ. The data line groups A1 to A(N−1) are respectively located between the pixels on the same row. For example, the data lines S2 to S5 are located between the first column of the pixels (P11 to P1M) and the second column of the pixels (P21 to P2M). The data lines S0 to SQ are configured to write display data into the pixels when the pixels are turned on.

In the present embodiment, each of the scan lines G1 to GM is coupled to all of the pixels located on the same row among the pixels P11 to PNM. For example, because the scan line G1 is coupled to the first row of the pixels (P11 to PN1), when the scan signal of the scan line G1 is at a high level, the pixels P11 to PN1 located on the same row are turned on at the same time. Connecting relations between the scan lines G2 to GM and each of the pixels are as shown in FIG. 1B, which may be deduced by analogy.

Furthermore, in the present embodiment, each of the data line groups A1 to AN includes four data lines. In correspondence with an amount of the data lines included in each of the data line groups A1 to AN, the scan lines G1 to GM are grouped into a plurality of scan line groups B1 to BZ, wherein Z is a positive integer greater than 1. Each of the scan line groups B1 to BZ includes four scan lines among the scan lines G1 to GM. As shown in FIG. 4, within the same driving timing sequence, the scan signals corresponding to the scan line groups are in a high level state at the same time, so as to turn on the row of the pixels coupled to each of the scan line groups altogether. For instance, in FIG. 6, the scan signals of the scan lines G1 to G4 of the scan line group B1 are in the high level state at the same time within one driving timing sequence. The scan signals of the scan lines G5 to G8 of the scan line group B2 are also in the high level state at the same time within another driving timing sequence. In the present embodiment, the level states of the scan signals of the rest of the scan lines may be inferred by analogy, which are not repeated hereinafter.

In other words, in the present embodiment, an amount of the data lines included in each of data line groups A1 to AN is equal to an amount of the scan lines included in each of the scan line groups B1 to BZ. For example, in the present embodiment, because each of the data line groups A1 to AN includes four data lines among the data lines S0 to SQ, each of the scan line groups B1 to BZ includes four scan lines as the corresponding amount. That is to say, the scan line group B1 includes the scan lines G1 to G4. Each one of the four scan lines included in each of the scan line groups B1 to BZ is configured to correspondingly turn on all of the pixels located on the same row. For example, the scan lines G1 to G4 included in the scan line group B1 are configured to correspondingly turn on the pixels P11 to PN1, the pixels P12 to PN2, the pixels P13 to PN3, and the pixels P14 to PN4.

FIG. 5 is a schematic diagram illustrating a part of the pixels in the embodiment of FIG. 4. Specifically, referring to FIG. 5, in the present embodiment, the data lines S1 to S15 are respectively coupled to a part of the pixels located on the same column among the pixels P11 to P44. In the present embodiment, in the data line group A1, the pixels P11, P12, P21 and P22 in which the display data is written by the data lines S2 to S5 are distributed at two sides of the data lines S2 to S5. In the present embodiment, in the data line group A1, the pixel P11 and the pixel P12 among the pixels P11, P12, P21 and P22 in which the display data is written by the data lines S2 to S5 are located on the same column. In the present embodiment, in the data line group A1, the pixels P11 and P12 and the pixels P21 and P22 among the pixels P11, P12, P21 and P22 in which the display data is written by the data lines S2 to S5 are not located on the same column. In the present embodiment, in the data line group A1, a part of the pixels (P11, P21) among the pixels P11, P12, P21 and P22 in which the display data is written by the data lines S2 to S5 is located on the same row. In the exemplary embodiments of the invention, the connecting relation between the data line group and the pixels is not limited only to the above. In an embodiment, in at least a part of the data line groups, it is also possible that all of the pixels among the pixels in which the display data is written by the data lines are not located on the same row.

In addition, sufficient teaching, suggestion, and implementation illustration regarding a driving method of the display panel as well as operations and functions of other elements in the embodiments of the invention may be obtained from the foregoing embodiments of FIG. 1B to FIG. 3, thus related descriptions thereof are not repeated hereinafter.

It should be noted that, in the embodiments depicted in FIG. 1B and FIG. 4, the amounts of the data lines included in the data line group are three and four, respectively. However, the embodiments of FIG. 1B and FIG. 4 are not intended to limit the invention. Any amount of the data lines may be used to realize aforesaid operation method as long as said amount is three or more. In addition, although the scan line groups in the invention are illustrated as the adjacent scan lines, the foregoing embodiments are not intended to limit a position relation of the scan lines. As long as the scan lines has the amount corresponding to the amount of the data lines, any number of the scan lines may be arbitrary selected from among all the scan lines to serve as a component element of the scan line group.

In the forgoing embodiments of FIG. 4 to FIG. 6, the amount of the data lines included in each of the data line groups is four, but the invention is not limited thereto. In other embodiments, each of the data line groups can also include more than four data lines, such as an R number of data lines in which R is a positive integer greater than 4. For embodiments in which each of the data line groups includes more than four data lines, sufficient teaching, suggestion, and implementation illustration regarding a driving method of the display panel as well as operations and functions of other elements in the embodiments of the invention may be obtained from the foregoing embodiments of FIG. 1B to FIG. 6, thus related descriptions thereof are not repeated hereinafter.

Figure 7:
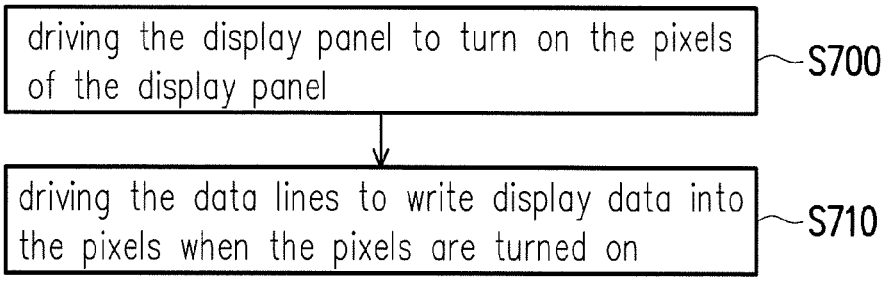
FIG. 7 is a flowchart illustrating steps of a method for driving a display panel according to an embodiment of the invention.

FIG. 7 is a flowchart illustrating steps of a method for driving a display panel according to an embodiment of the invention. Referring to FIG. 1A and FIG. 7, the method for driving the display panel of the present embodiment may be performed by the driver unit 410 and includes following steps. In step S700, the driver unit 410 drives the display panel 100 to turn on the pixels P11 to PNM. Subsequently, in step S710, the driver unit 410 drives the data lines S0 to SP to write display data into the pixels P11 to PNM when the pixels P11 to PNM are turned on.

Besides, the method for driving the display panel described in this embodiment of the invention is sufficiently taught, suggested, and embodied in the embodiments illustrated in FIG. 1A to FIG. 6, and therefore no further description is provided herein.

In summary, in the exemplary embodiments of the invention, at least three data lines are included between the pixels of the display panel in order to improve a charging speed for the pixels. In accordance with the amount of the data lines of the data line group, the driving waveform and the driving timing sequence of the scan signals for driving the display panel may also be adjusted, so as to overcome the issue that the charging time is insufficient.

Although the present invention has been described with reference to the above embodiments, it will be apparent to one of ordinary skill in the art that modifications to the described embodiments may be made without departing from the spirit of the invention. Accordingly, the scope of the invention will be defined by the attached claims and not by the above detailed descriptions.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A display driving apparatus, driving a display panel, wherein the display panel comprises a plurality of pixels arranged in an array, and the array comprises a plurality of columns and a plurality of rows, the display driving apparatus comprising:

a driver, electrically connected to the display panel and driving the display panel to turn on the pixels of the display panel, wherein the display panel further comprises a plurality of scan lines and a plurality of data lines, wherein each of the scan lines is coupled to a plurality of pixels located on the same row among the pixels, and each of the data lines is coupled to a plurality of pixels located on the same column among the pixels, wherein the data lines are grouped into a plurality of data line groups, each of the data line groups comprises three or more data lines among the data lines, and the data line groups are respectively located between two corresponding neighboring columns of pixels, and the driver drives the data line groups to write display data into the pixels when the pixels are turned on, wherein each of the data line groups is coupled to a plurality of pixels located on two different columns among the pixels, and the two different columns locate at two sides of the data line group, wherein the pixels located on the two different columns and coupled to one of the data line groups comprise a first pixel, a second pixel and a third pixel, and the first pixel and the second pixel are located on a first row, and the third pixel is located on a second row neighboring to the first row.

2. The display driving apparatus of claim 1, wherein in the display panel, each of the data lines is coupled to a part of the pixels located on the same column among the pixels.

3. The display driving apparatus of claim 1, wherein in the display panel, in at least a part of the data line groups, the pixels in which the display data is written by the three or more data lines are distributed at two sides of the three or more data lines.

4. The display driving apparatus of claim 1, wherein in the display panel, in at least a part of the data line groups, a part of the pixels among the pixels in which the display data is written by the three or more data lines is located on the same column.

5. The display driving apparatus of claim 1, wherein in the display panel, in at least a part of the data line groups, at least one pixel among the pixels in which the display data is written by the three or more data lines is located on a first column of the columns, other pixels among the pixels in which the display data is written by the three or more data lines are located on a second column of the columns, and the first column is distinct from the second column.

6. The display driving apparatus of claim 1, wherein in the display panel, in at least a part of the data line groups, a part of the pixels among the pixels in which the display data is written by the three or more data lines is located on the same row.

7. The display driving apparatus of claim 1, wherein in the display panel, in at least a part of the data line groups, all of the pixels among the pixels in which the display data is written by the three or more data lines are not located on the same row.

8. The display driving apparatus of claim 1, wherein the scan lines are grouped into a plurality of scan line groups, each of the scan line groups includes three or more scan lines among the scan lines, and an amount of the data lines included in each of data line groups is equal to an amount of the scan lines included in each of the scan line groups.

9. The display driving apparatus of claim 8, wherein the driver drives the display panel to turn on rows of the pixels connected to the scan lines of each of the scan line groups at the same time.

10. The display driving apparatus of claim 8, wherein in the display panel, in at least a part of the scan line groups, the three or more scan lines are adjacent to one another.

11. The display driving apparatus of claim 8, wherein in the display panel, in at least a part of the scan line groups, one of the scan lines among the three or more scan lines is not adjacent to the other scan lines among the three or more scan lines.

12. The display driving apparatus of claim 8, wherein in the display panel, in at least a part of the scan line groups, the three or more scan lines are not adjacent to one another.

13. A method for driving a display panel, wherein the display panel comprises a plurality of pixels, a plurality of scan lines and a plurality of data lines, the method comprising:

driving the display panel to turn on the pixels of the display panel; and driving the data lines to write display data into the pixels when the pixels are turned on, wherein the pixels are arranged in an array, the array comprises a plurality of columns and a plurality of rows, each of the scan lines is coupled to a plurality of pixels located on the same row among the pixels, and each of the data lines is coupled to a plurality of pixels located on the same column among the pixels, wherein the data lines are grouped into a plurality of data line groups, each of the data line groups comprises three or more data lines among the data lines, and the data line groups are respectively located between two corresponding neighboring columns of pixels, wherein each of the data line groups is coupled to a plurality of pixels located on two different columns among the pixels, and the two different columns locate at two sides of the data line group, wherein the pixels located on the two different columns and coupled to one of the data line groups comprise a first pixel, a second pixel and a third pixel, and the first pixel and the second pixel are located on a first row, and the third pixel is located on a second row neighboring to the first row.

14. The method of claim 13, wherein in the display panel, each of the data lines is coupled to a part of the pixels located on the same column among the pixels.

15. The method of claim 13, wherein in the display panel, in at least a part of the data line groups, the pixels in which the display data is written by the three or more data lines are distributed at two sides of the three or more data lines.

16. The method of claim 13, wherein in the display panel, in at least a part of the data line groups, a part of the pixels among the pixels in which the display data is written by the three or more data lines is located on the same column.

17. The method of claim 13, wherein in the display panel, in at least a part of the data line groups, at least one pixel among the pixels in which the display data is written by the three or more data lines is located on a first column of the columns, other pixels among the pixels in which the display data is written by the three or more data lines are located on a second column of the columns, and the first column is distinct from the second column.

18. The method of claim 13, wherein in the display panel, in at least a part of the data line groups, a part of the pixels among the pixels in which the display data is written by the three or more data lines is located on the same row.

19. The method of claim 13, wherein in the display panel, in at least a part of the data line groups, all of the pixels among the pixels in which the display data is written by the three or more data lines are not located on the same row.

20. The method of claim 13, wherein the scan lines are grouped into a plurality of scan line groups, each of the scan line groups includes three or more scan lines among the scan lines, and an amount of the data lines included in each of data line groups is equal to an amount of the scan lines included in each of the scan line groups.

21. The method of claim 20, wherein rows of the pixels connected to the scan lines of each of the scan line groups are turned on at the same time.

22. The method of claim 20, wherein in the display panel, in at least a part of the scan line groups, the three or more scan lines are adjacent to one another.

23. The method of claim 20, wherein in the display panel, in at least a part of the scan line groups, one of the scan lines among the three or more scan lines is not adjacent to the other scan lines among the three or more scan lines.

24. The method of claim 20, wherein in the display panel, in at least a part of the scan line groups, the three or more scan lines are not adjacent to one another.

25. A display driving apparatus, driving a display panel, wherein the display panel comprises a plurality of pixels arranged in an array, and the array comprises a plurality of columns and a plurality of rows, the display driving apparatus comprising:

a driver, electrically connected to the display panel and driving the display panel to turn on the pixels of the display panel, wherein the display panel further comprises a plurality of scan lines and a plurality of data lines, wherein each of the scan lines is coupled to a plurality of pixels located on the same row among the pixels, and each of the data lines is coupled to a plurality of pixels located on the same column among the pixels, wherein the data lines are grouped into a plurality of data line groups, each of the data line groups comprises three or more data lines among the data lines, and the data line groups are respectively located between two corresponding neighboring columns of pixels, and the driver drives the data line groups to write display data into the pixels when the pixels are turned on, wherein each of the data line groups is coupled to a plurality of pixels located on two different columns among the pixels, and the two different columns locate at two sides of the data line group, wherein the scan lines are grouped into a plurality of scan line groups, each of the scan line groups includes three or more scan lines among the scan lines, and an amount of the data lines included in each of data line groups is equal to an amount of the scan lines included in each of the scan line groups, and wherein the three or more data lines included in one of the data line groups are coupled to at least the same amount pixels which are coupled to the same amount of scan lines which are included in the same one of the scan line groups.

26. The display driving apparatus of claim 25, wherein the pixels located on the two different columns and coupled to one of the data line groups comprise a first pixel and a second pixel, and the first pixel and the second pixel are located on the same row.

27. The display driving apparatus of claim 26, wherein the pixels located on the two different columns and coupled to the one of the data line groups further comprise a third pixel, and the first pixel and the second pixel are located on a first row, and the third pixel is located on a second row neighboring to the first row.

28. A display driving method for driving a display panel, wherein the display panel comprises a plurality of pixels arranged in an array, and the array comprises a plurality of columns and a plurality of rows, the display driving method comprising:

sequentially turning on the rows of pixels scan through a plurality of scan line groups, wherein each of the scan line groups includes an amount of scan lines and the amount is three or more, and in the turning on the rows of pixels coupled to the scan lines included in one of the scan line groups, a plurality of gate signals provided to the scan lines of the scan line group are simultaneously turned to the same level; and providing pixel data to the pixels arranged in the array through a plurality of data line groups each located between two corresponding neighboring columns of pixels, wherein each of the data line groups includes the same amount of data lines as the amount of the scan lines in one scan line group, and when one of the scan line groups are provided with the same level of the gate signals, among the pixels coupled to the scan line group and coupled to one of the scan line groups, the same amount of pixels are simultnantously turned on through the same amount of scan lines to be provided with pixel data through the same amount of data lines.

* * * * *